US006648801B2

(12) United States Patent
Stearns et al.

(10) Patent No.: US 6,648,801 B2
(45) Date of Patent: Nov. 18, 2003

(54) EXERCISE APPARATUS WITH ELLIPTICAL FOOT MOTION

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 09/917,002

(22) Filed: Jul. 27, 2001

(65) Prior Publication Data

US 2001/0051562 A1 Dec. 13, 2001

Related U.S. Application Data

(63) Continuation-in-part of application No. 09/748,396, filed on Dec. 26, 2000, now Pat. No. 6,554,750, which is a continuation of application No. 09/072,765, filed on May 5, 1998, now Pat. No. 6,171,215, which is a continuation-in-part of application No. 09/064,393, filed on Apr. 22, 1998, now Pat. No. 5,882,281.

(51) Int. Cl.[7] ..... A63B 22/04

(52) U.S. Cl. ..... 482/52; 482/57; 482/70

(58) Field of Search ..... 482/51, 52, 53, 482/57, 70, 79, 80

(56) References Cited

U.S. PATENT DOCUMENTS

| | | | | | |
|---|---|---|---|---|---|
| 5,788,610 | A | * | 8/1998 | Eschenbach | 482/52 |
| 6,077,196 | A | * | 6/2000 | Eschenbach | 482/51 |
| 6,090,013 | A | * | 7/2000 | Eschenbach | 482/52 |
| 6,248,046 | B1 | * | 6/2001 | Maresh et al. | 482/57 |
| 6,277,054 | B1 | * | 8/2001 | Kuo | 482/51 |

* cited by examiner

*Primary Examiner*—Stephen R. Crow

(57) ABSTRACT

An exercise apparatus includes a frame; left and right cranks rotatably mounted on the frame; left and right rocker links pivotally mounted on the frame; and left and right foot supporting bars having rearward ends rotatably connected to respective cranks and forward ends supported by respective rocker assemblies. The resulting assemblies link rotation of the cranks to generally elliptical motion of a person's feet. Left and right handles are preferably secured to upper ends of respective intermediate links to provide coordinated arm and leg exercise motion.

18 Claims, 16 Drawing Sheets

Fig. 16
Fig. 18
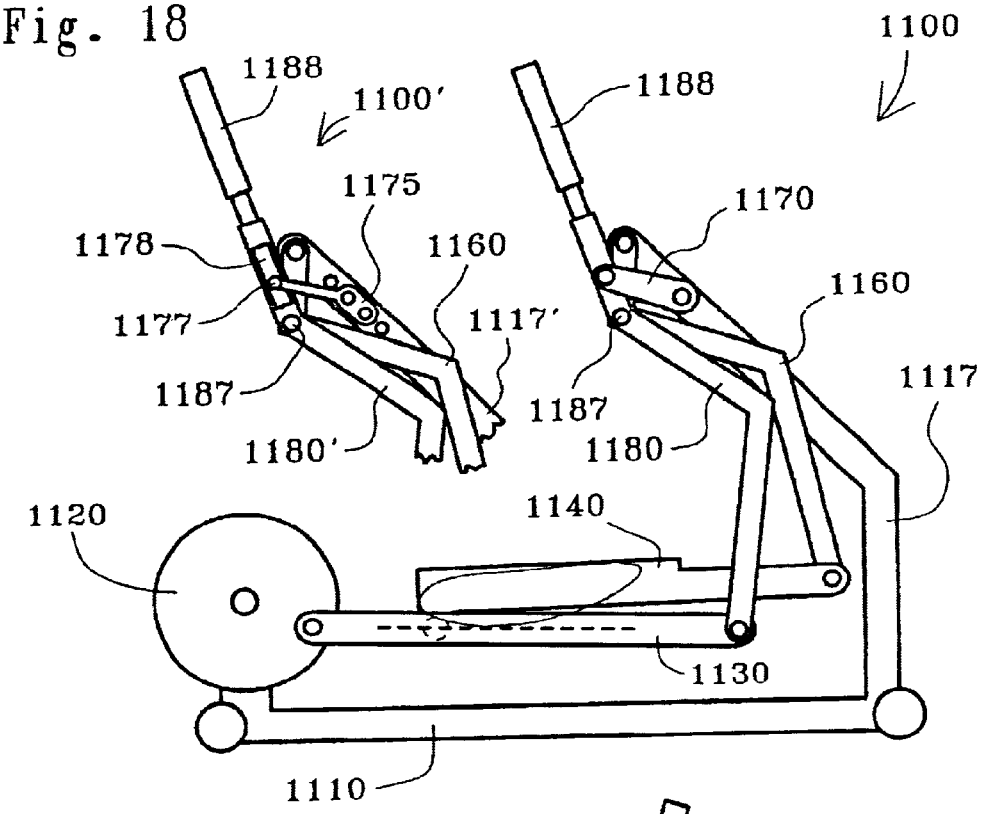
Fig. 17
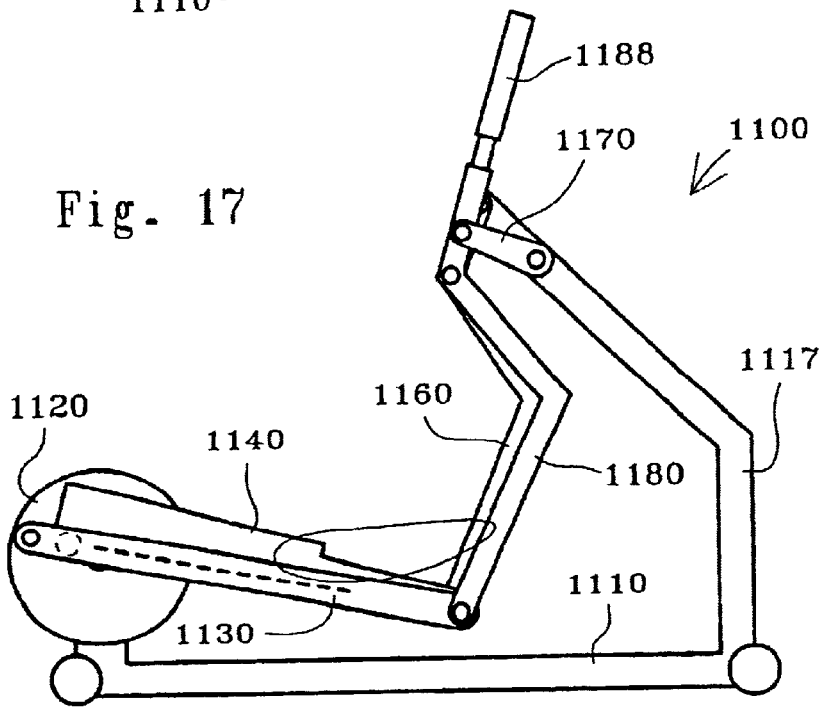

EXERCISE APPARATUS WITH ELLIPTICAL FOOT MOTION

CROSS-REFERENCE TO RELATED APPLICATIONS

This is a continuation-in-part of U.S. patent application Ser. No. 09/748,396, filed on Dec. 26, 2000 now U.S. Pat. No. 6,554,750, which in turn, is a continuation of U.S. patent application Ser. No. 09/072,765, filed on May 5, 1998 (U.S. Pat. No. 6,171,215), which in turn, is a continuation-in-part of U.S. patent application Ser. No. 09/064,393, filed on Apr. 22, 1998 (U.S. Pat. No. 5,882,281).

FIELD OF THE INVENTION

The present invention relates to exercise methods and apparatus and more particularly, to exercise equipment which facilitates movement of a person's feet through generally elliptical paths.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses a linkage assembly to convert a relatively simple motion, such as circular, into a relatively more complex motion, such as elliptical. For example, see U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; and U.S. Pat. No. 5,792,026 to Maresh et al.

SUMMARY OF THE INVENTION

The present invention provides a novel linkage assembly and corresponding exercise apparatus suitable for linking circular motion to relatively more complex, generally elliptical motion. The present invention may be described in terms of left and right foot supporting assemblies having one end connected to the frame by means of respective cranks, and another end connected to the frame by means of respective rocker assemblies, each including at least two links pivotally connected in series.

On one embodiment, the foot supporting assemblies include left and right foot supporting bars that are movably interconnected between respective cranks and respective rocker assemblies, and left and right foot platforms that are rigidly mounted on respective bars. The foot platforms are thereby constrained to move together with the bars through generally elliptical paths of motion.

On another embodiment, the foot supporting assemblies include left and right rails that are rotatably interconnected between respective cranks and respective rocker assemblies, and left and right foot skates that are movably mounted on respective rails. The rocker assemblies are linked to the foot skates in a manner that constrains the foot skates to move back and forth along respective rails as the rails move through respective elliptical paths. The extent of relative motion between the skates and the rails is selectively adjustable.

Among other things, handlebars may be connected to the rocker assemblies in a manner that provides coordinated arm exercise motion through generally elliptical paths. Various features and/or advantages of the present invention will become apparent from the more detailed description that follows.

BRIEF DESCRIPTION OF THE DRAWING

With reference to the Figures of the Drawing, wherein like numerals represent like parts and assemblies throughout the several views.

FIG. 16 is a side view of yet another exercise apparatus constructed according to the principles of the present invention;

FIG. 17 is a side view of the exercise apparatus of FIG. 16, shown at a different point in an exercise cycle; and FIG. 18 is a side view of an alternative linkage suitable for use on the exercise apparatus of FIG. 16.

DETAILED DESCRIPTION OF THE PREFERRED EMBODIMENT

The present invention provides elliptical motion exercise machines and methods that link rotation of left and right cranks to generally elliptical motion of left and right foot supports. The term "elliptical motion" is intended in a broad sense to describe a closed path of motion having a relatively longer, major axis and a relatively shorter, minor axis (which extends perpendicular to the major axis).

The embodiments disclosed herein are generally symmetrical about a vertical plane extending lengthwise through a floor-engaging base. Linkage assembly components on the left side of the machines are preferably one hundred and eighty degrees out of phase relative to their opposite side counterparts. Also, to the extent that reference is made to forward or rearward portions of a machine, it is to be understood that a person can typically exercise while facing in either direction relative to the disclosed linkage assembly.

Figure 1:
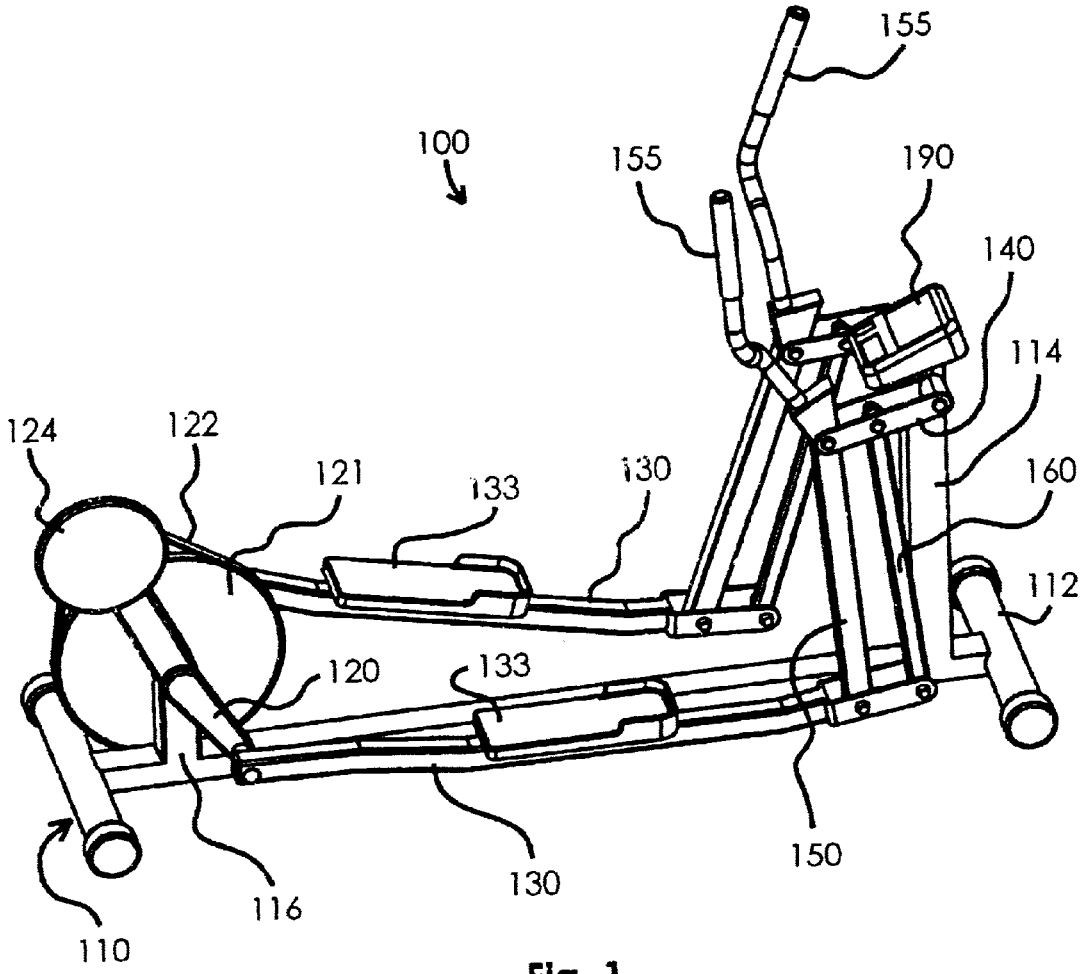
FIG. 1 is a perspective view of an exercise apparatus constructed according to the principles of the present invention.
Figure 2:
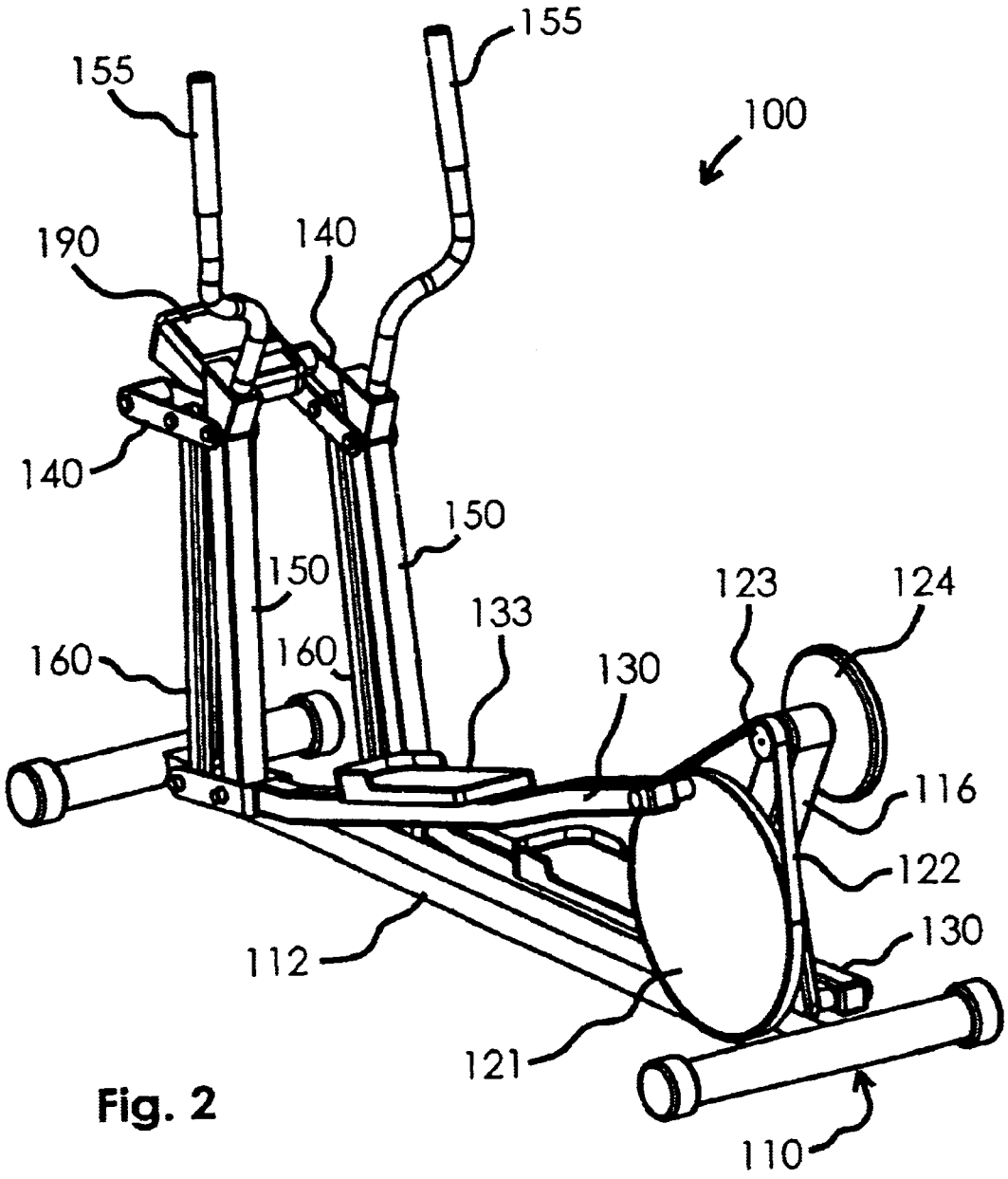
FIG. 2 is a different perspective view of the exercise apparatus of FIG. 1.
Figure 3:
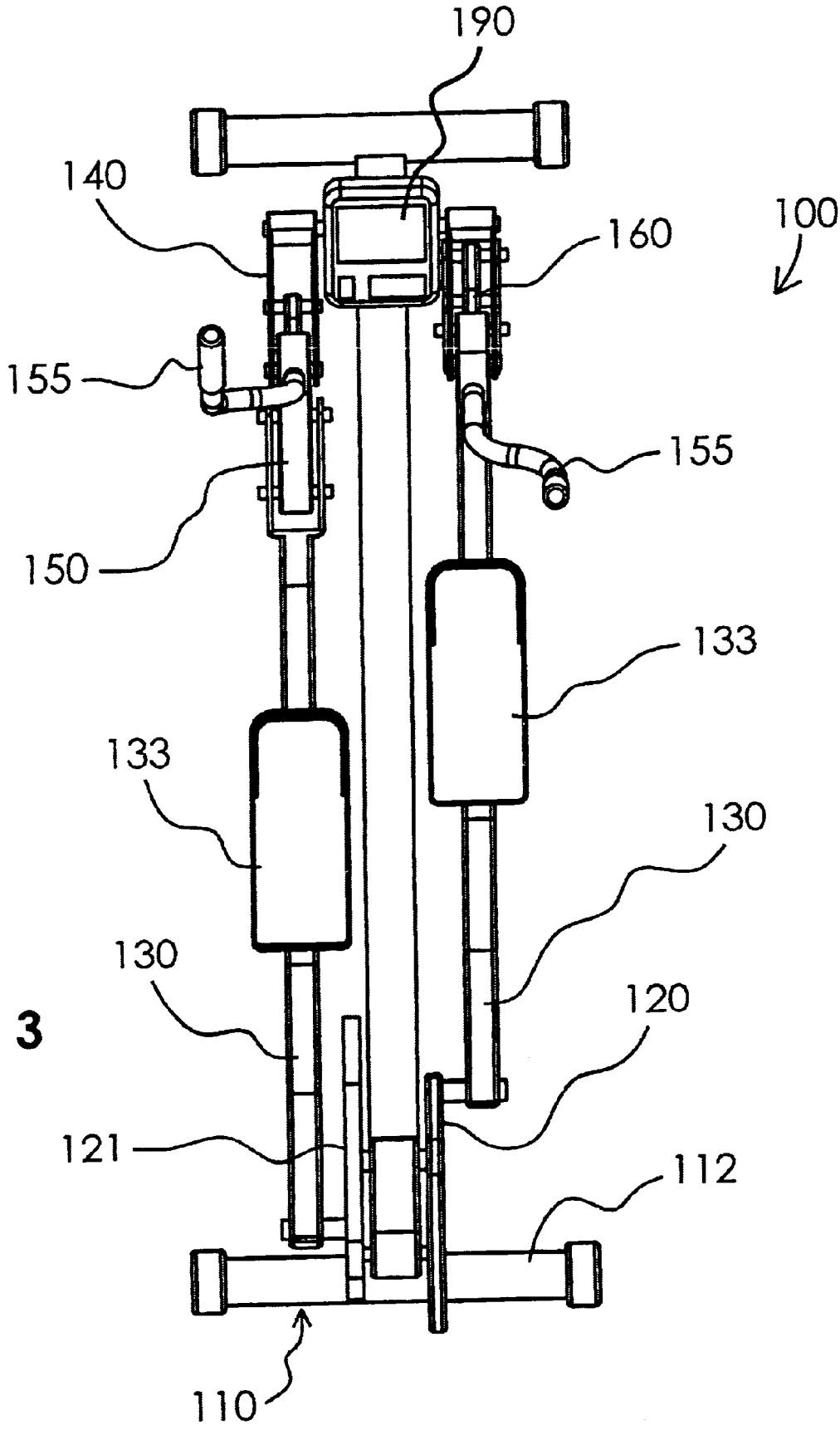
FIG. 3 is a top view of the exercise apparatus of FIG. 1.
Figure 4:
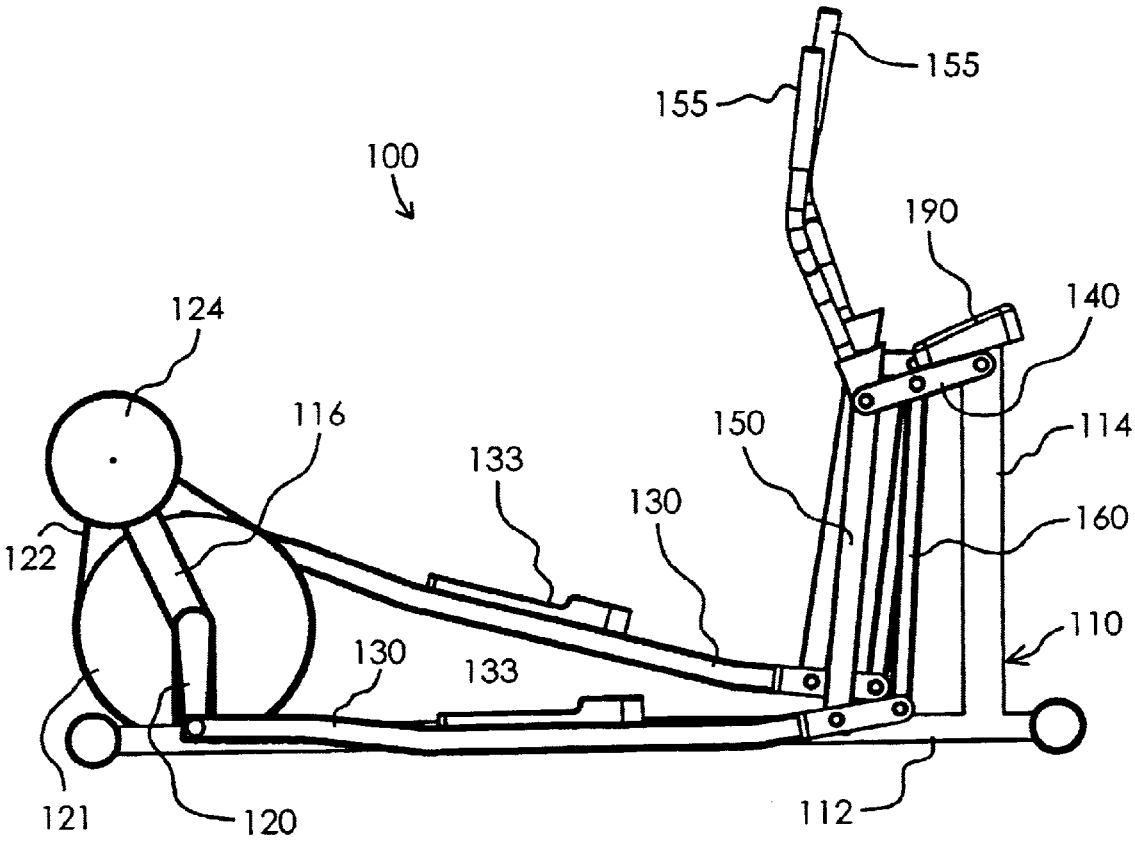
FIG. 4 is a side view of the exercise apparatus of FIG. 1.

One embodiment of the present invention is shown in FIGS. 1–3 and assigned reference numeral 100. The machine 100 generally includes left and right linkage assemblies movably mounted on respective sides of a frame 110. A user interface 190 is preferably mounted on the frame 110 to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

The frame 110 includes a floor engaging base 112; a forward stanchion 114 that extends upward from the base 112, proximate the front end of the frame 110; and a rearward stanchion 116 that extend upward from the base 112, proximate the rear end of the frame 110. The forward stanchion 114 supports the user interface 190, and may be configured to support additional items, such a water bottle, for example.

Each linkage assembly includes a crank 120 or 121 rotatably mounted on a respective side of the rearward stanchion 116 and rotatable about a common crank axis. The crank 121 is shown as a disc or pulley that is connected to a relatively smaller pulley 123 by means of a belt 122. The smaller pulley 123 is rotatably mounted on the upper end of the rearward stanchion 116 and is keyed to a flywheel 124 that is similarly rotatably mounted on the upper end of the rearward stanchion 116. As a result of this arrangement, the flywheel 124 is constrained to rotate relatively faster than the cranks 120 and 121. Various known resistance devices may be connected to the flywheel 124 for purposes of providing adjustable resistance to rotation.

Each linkage assembly also includes a foot supporting bar 130 having a rearward end that is rotatably connected to a respective crank 120 or 121. The rearward ends of the bars 130 are diametrically opposed in relation to the rotational axis of the cranks 120 and 121. A respective foot platform 133 is mounted on an intermediate portion of each bar 130.

Each linkage assembly also includes a rocker link 140 having a forward end pivotally mounted on the forward stanchion 114 and pivotal about a common pivot axis. An opposite, rearward end of each rocker link 140 is pivotally connected to a respective first intermediate link 150. Each first intermediate link 150 has a lower end that is pivotally connected to a respective bar 130, and an opposite, upper end 155 that is sized and configured for grasping. An intermediate portion of each rocker link 140 is pivotally connected to an upper end of a respective second intermediate link 160. Each second intermediate link 160 has an opposite, lower end that is pivotally connected to a respective bar 130, forward of a respective first intermediate link 150.

Figure 5:
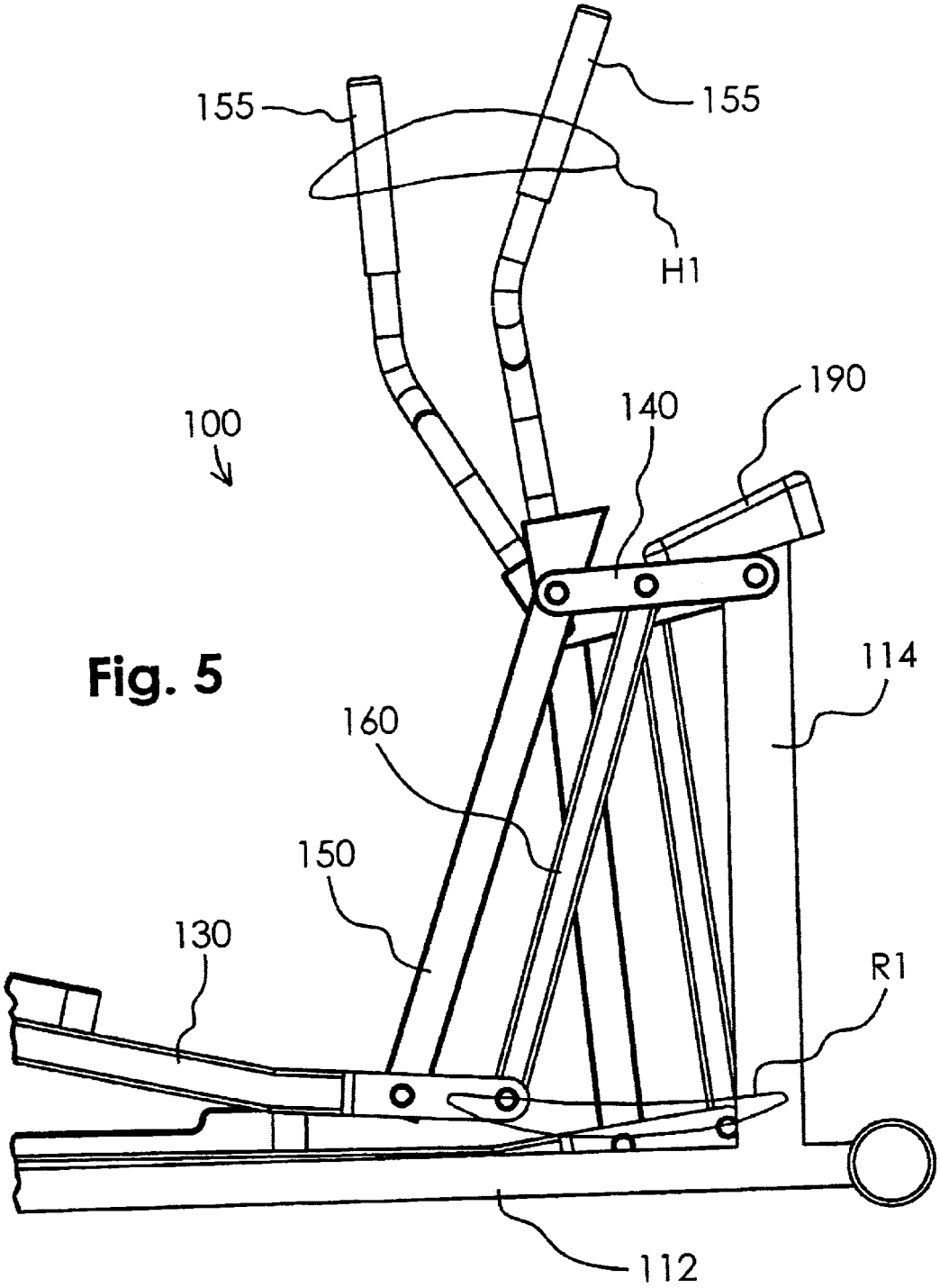
FIG. 5 is an enlarged view of a portion of the exercise apparatus of FIG. 1, show the paths traversed by certain components thereof.
Figure 6:
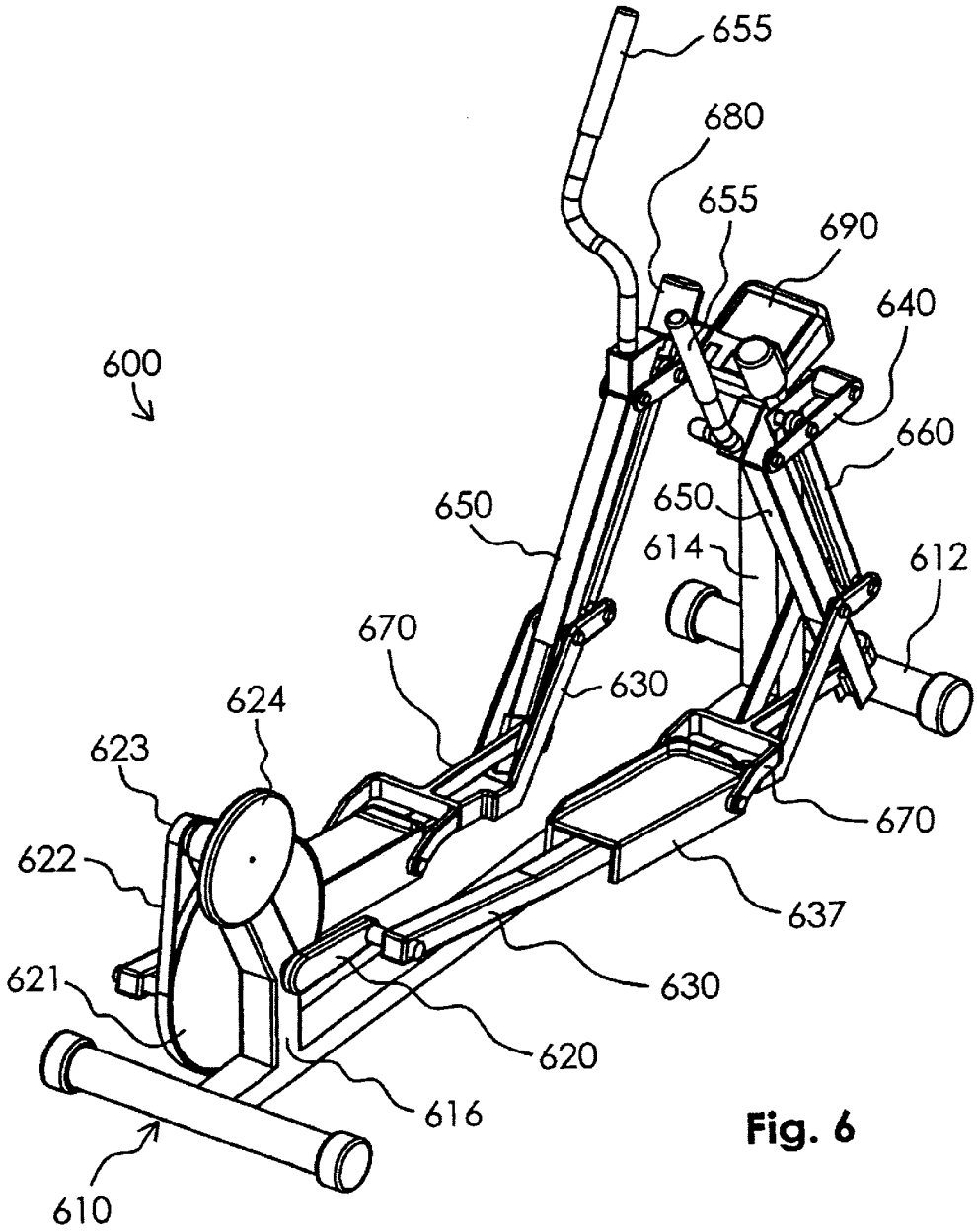
FIG. 6 is a perspective view of another exercise apparatus constructed according to the principles of the present invention.
Figure 7:
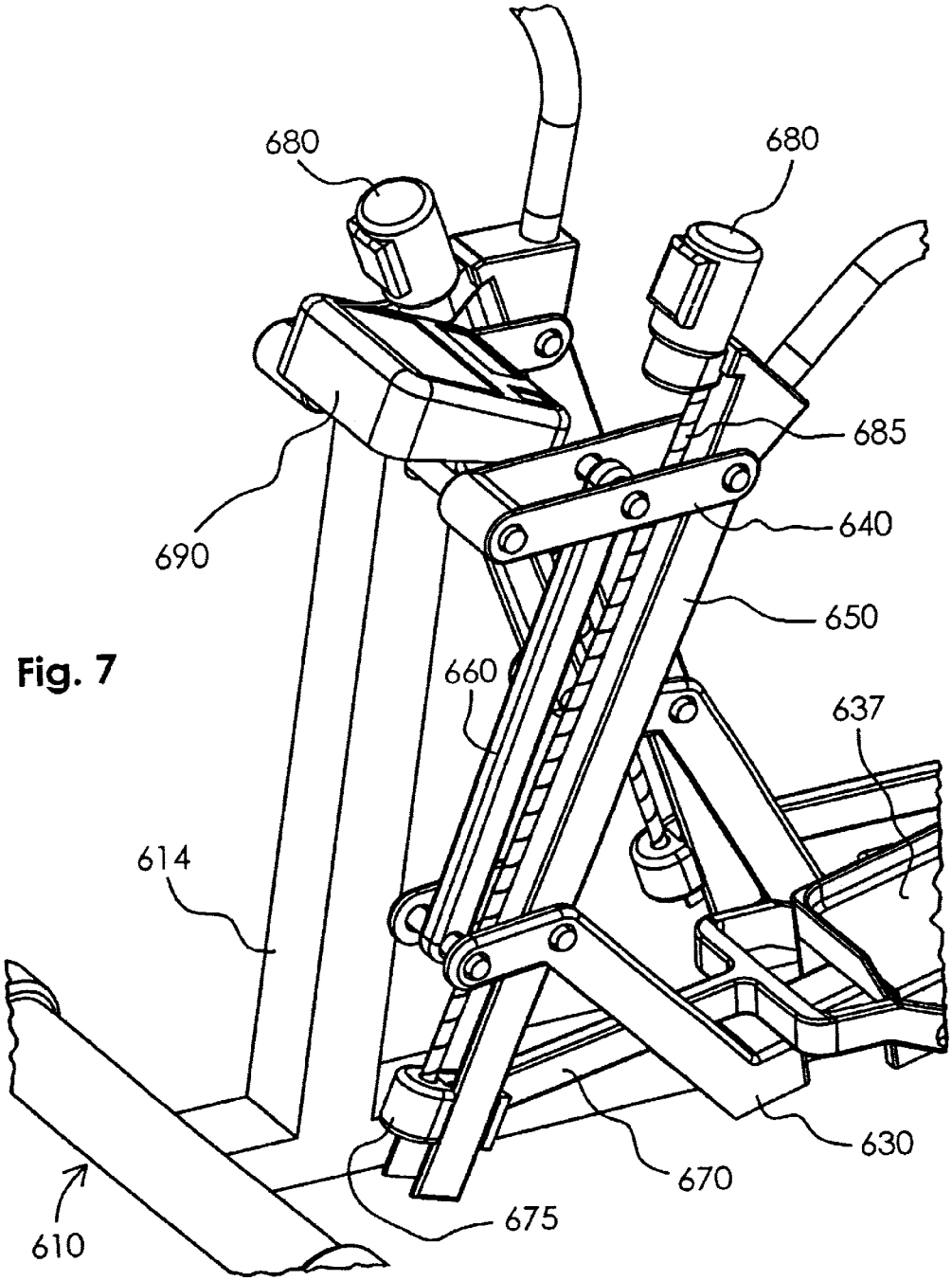
FIG. 7 an enlarged perspective view of a portion of the exercise apparatus of FIG. 6.
Figure 8:
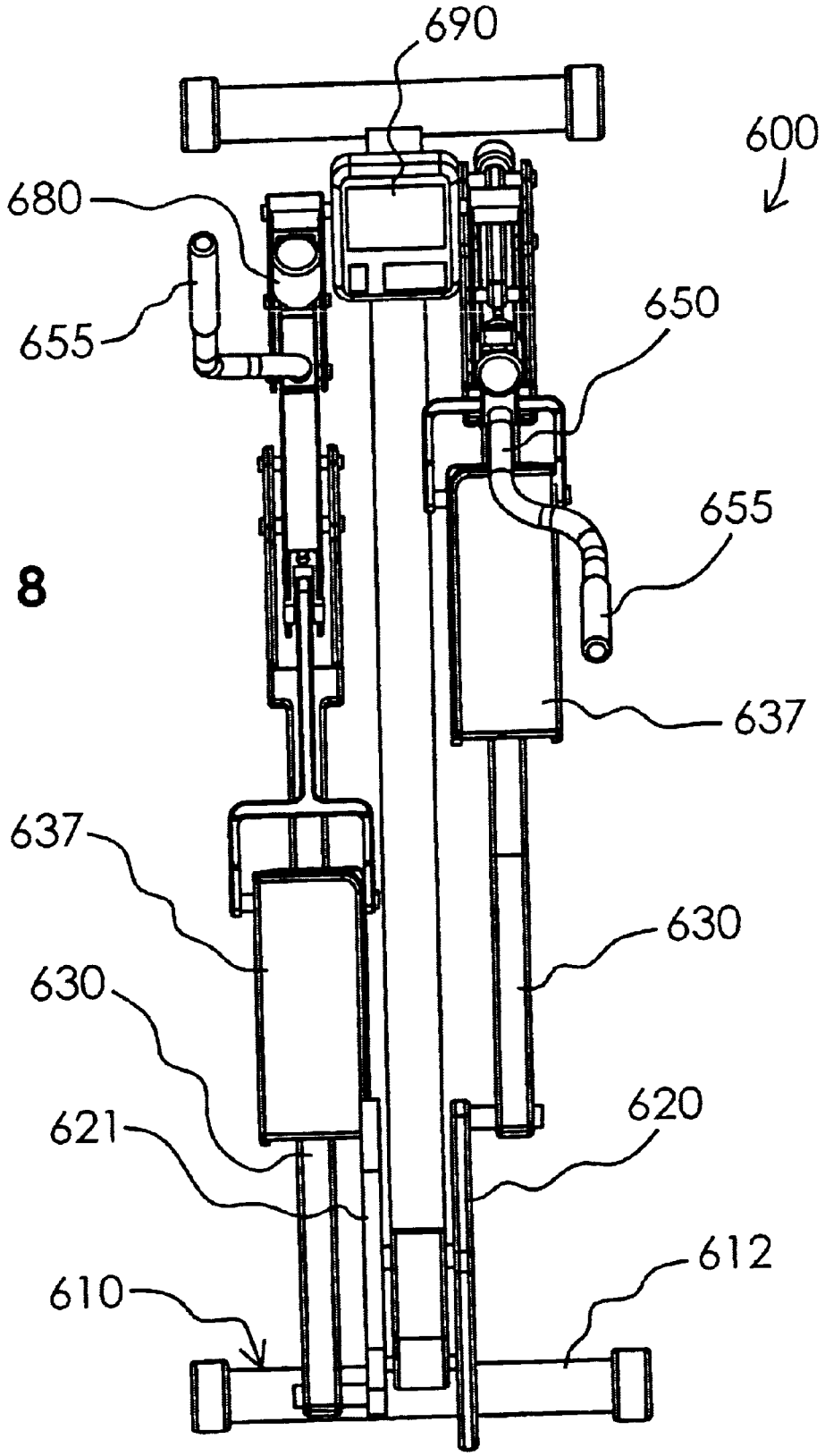
FIG. 8 is a top view of a the exercise apparatus of FIG. 6.

On each side of the machine 100, the intermediate links 150 and 160 cooperate with the rocker link 140 and the bar 130 to define a parallelogram four bar linkage. The arrangement links rotation of the cranks 120 and 121 to generally vertical pivoting of the rocker links 140 and generally horizontal pivoting of the intermediate links 150 and 160. Moreover, except for the points connected to respective cranks 120 and 121, all points on the bars 130 move through generally elliptical paths. FIG. 5 shows the path traversed by the pivot axis defined each forward intermediate link 150 and a respective foot supporting bar 130. FIG. 5 also shows that the handles 155 are constrained to move through generally elliptical paths H1, thereby providing a more fluid arm exercise motion to accompany the elliptical leg exercise motion.

Another embodiment of the present invention is shown in FIGS. 6–11 and designated by reference numeral 600. The exercise machine 600 includes a frame 610 having a floor engaging base 612; a forward stanchion 614 that extends upward from the base 612; and a rearward stanchion 616 that extends upward from the base 612.

As on the previous embodiment 100, cranks 620 and 621 are rotatably mounted on respective sides of the rearward stanchion 616 and rotatable about a common crank axis. The crank 621 is shown as a disc or pulley that is connected to a relatively smaller pulley 623 by means of a belt 622. The smaller pulley 623 is rotatably mounted on the upper end of the rearward stanchion 616 and is keyed to a flywheel 624 that is similarly rotatably mounted on the upper end of the rearward stanchion 616. As a result of this arrangement, the flywheel 624 is constrained to rotate relatively faster than the cranks 620 and 621. Various known resistance devices may be connected to the flywheel 624 for purposes of providing adjustable resistance to rotation.

Left and right foot supporting bars 630 have rearward ends that are rotatably connected to respective cranks 620 and 621, and diametrically opposed in relation to the rotational axis of the cranks 620 and 621. Also, left and right rocker links 640 have forward ends pivotally mounted on respective sides of the forward stanchion 614 and pivotal about a common pivot axis. An opposite, rearward end of each rocker link 640 is pivotally connected to a respective first intermediate link 650. Each first intermediate link 650 has a lower portion that is pivotally connected to a respective bar 630, and an opposite, upper portion 655 that is sized and configured for grasping. An intermediate portion of each rocker link 640 is pivotally connected to an upper end of a respective second intermediate link 660. Each second intermediate link 660 has an opposite, lower end that is pivotally connected to a respective bar 630, forward of a respective first intermediate link 650.

Figure 11:
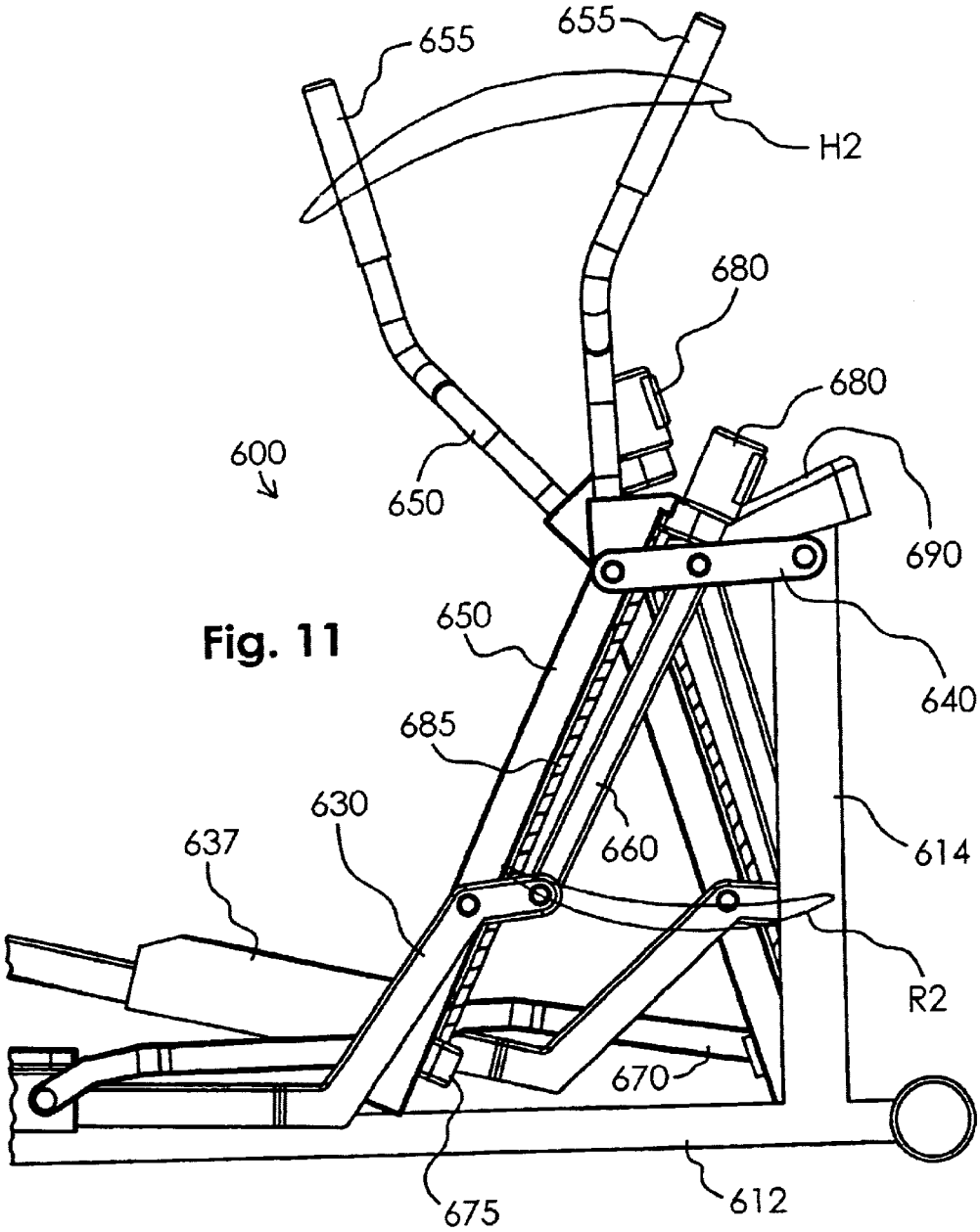
FIG. 11 is an enlarged side view of a portion of the exercise apparatus of FIG. 6.
Figure 12:
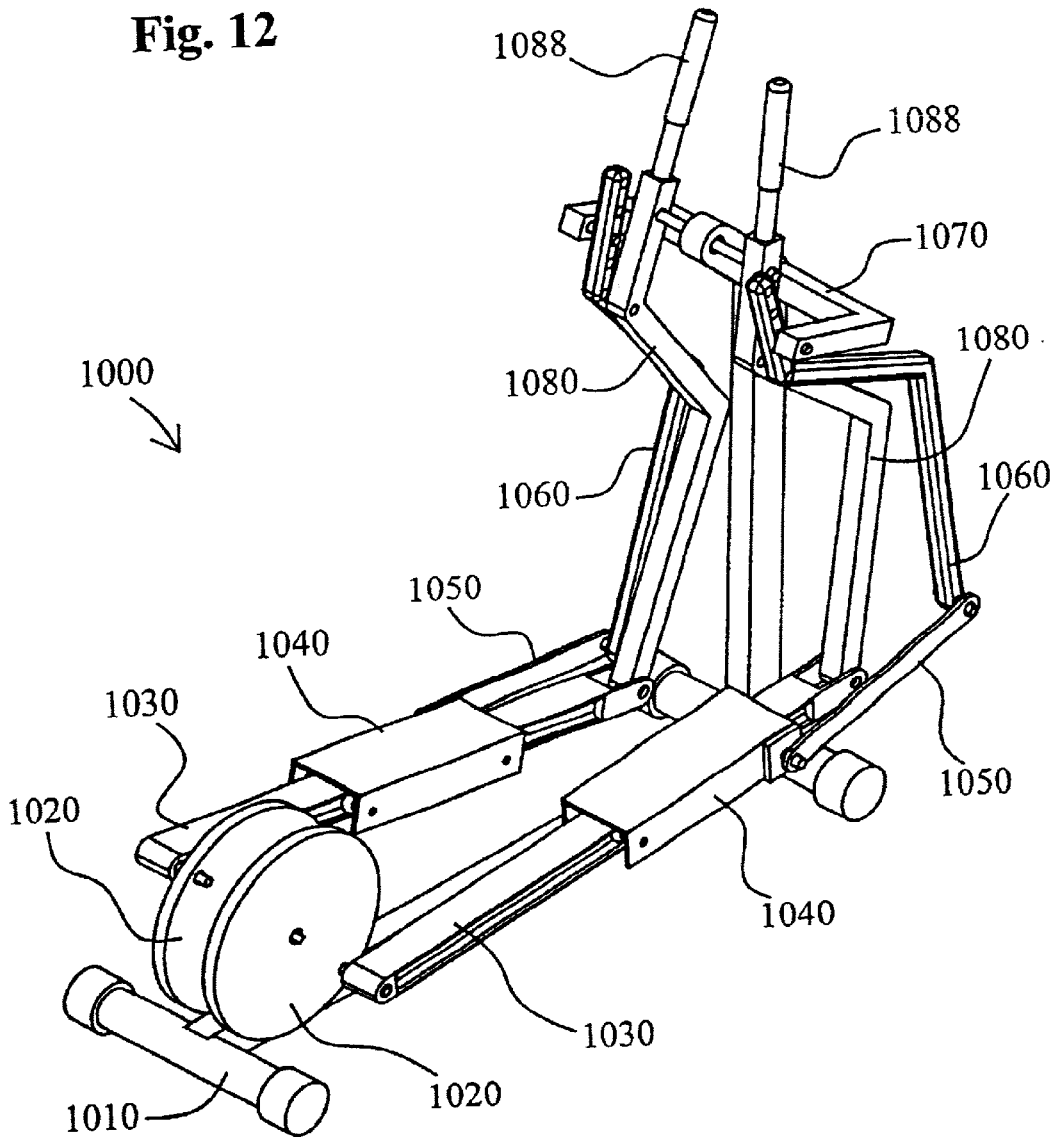
FIG. 12 is a perspective view of another exercise apparatus constructed according to the principles of the present invention.
Figure 13:
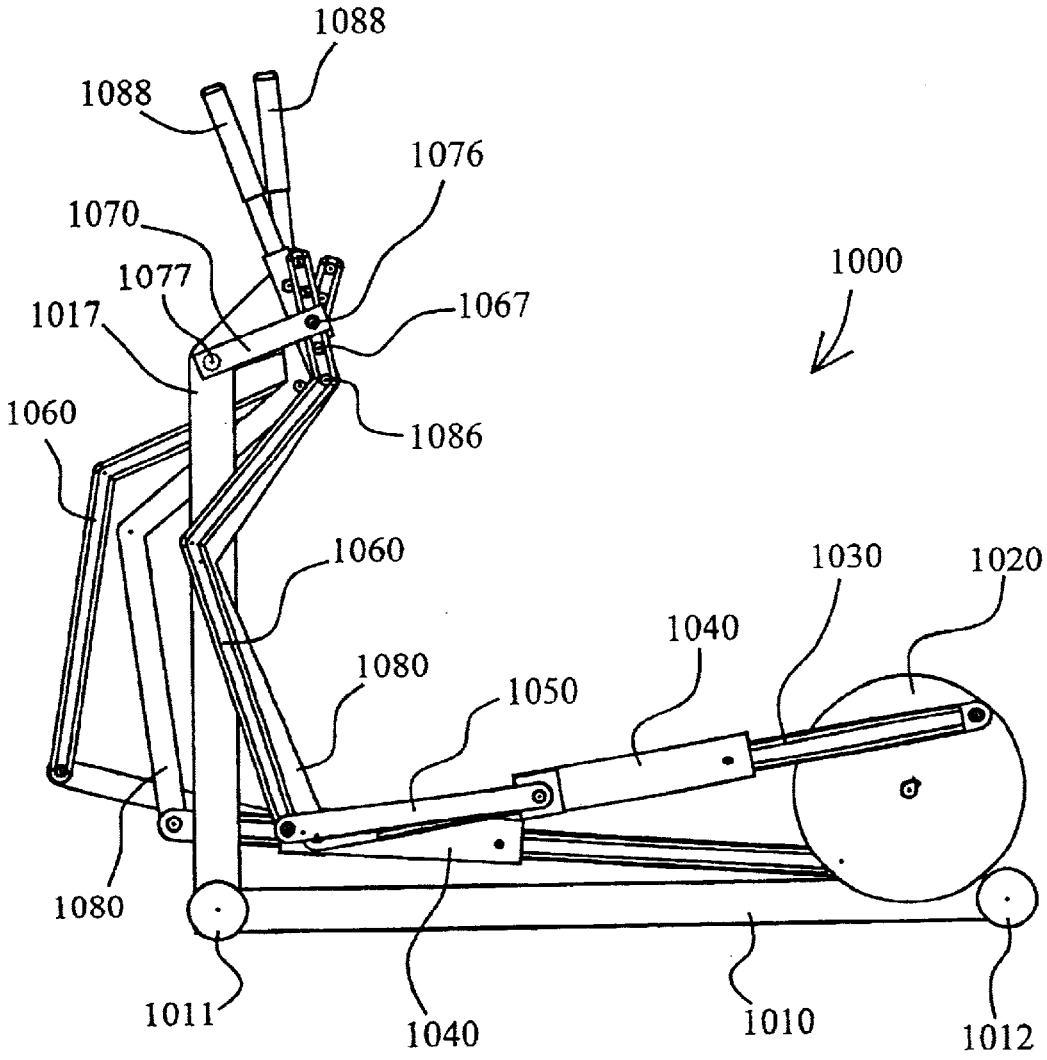
FIG. 13 is a side view of the exercise apparatus of FIG. 12.
Figure 14:
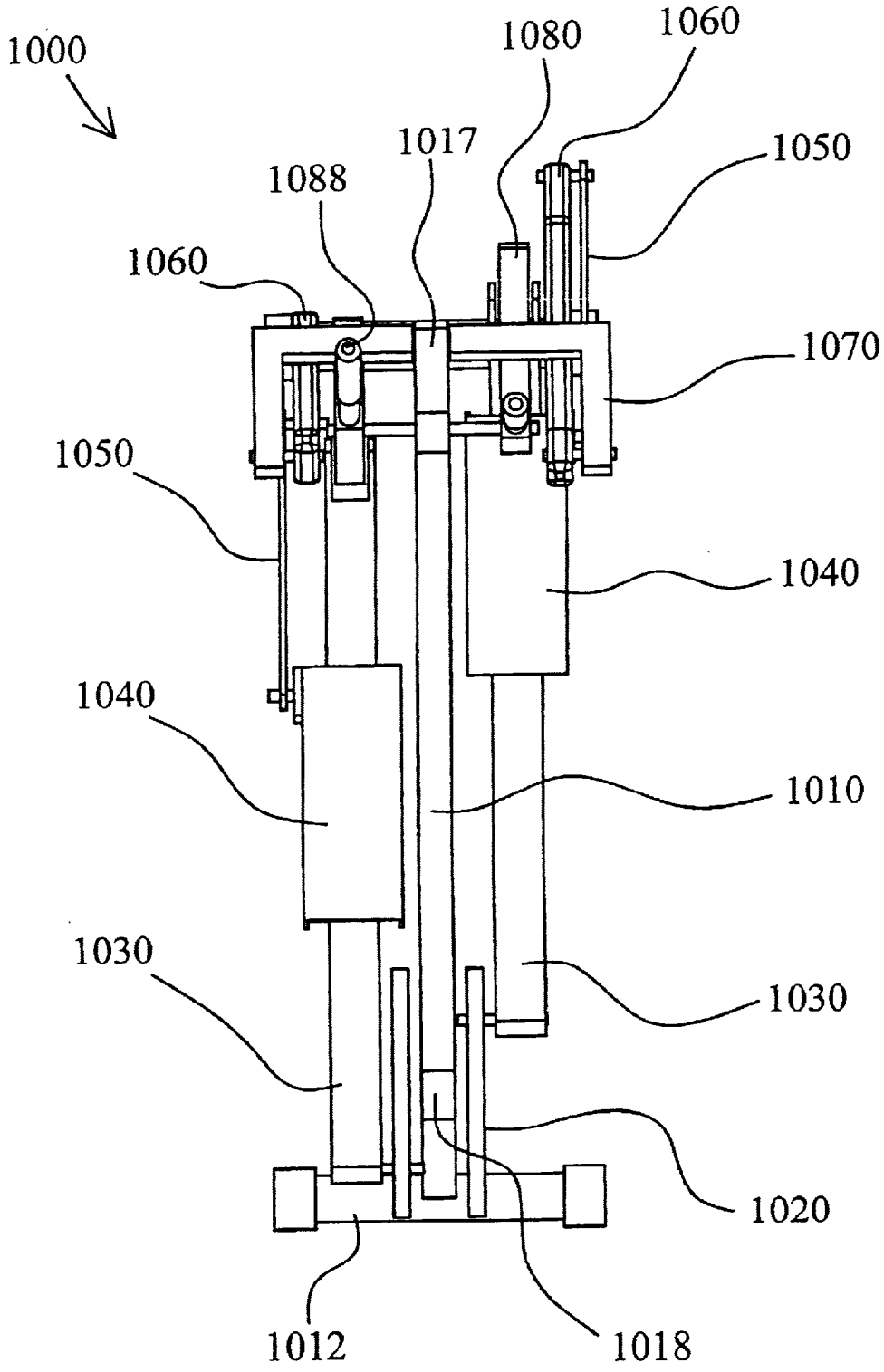
FIG. 14 is a top view of the exercise apparatus of FIG. 12.
Figure 15:
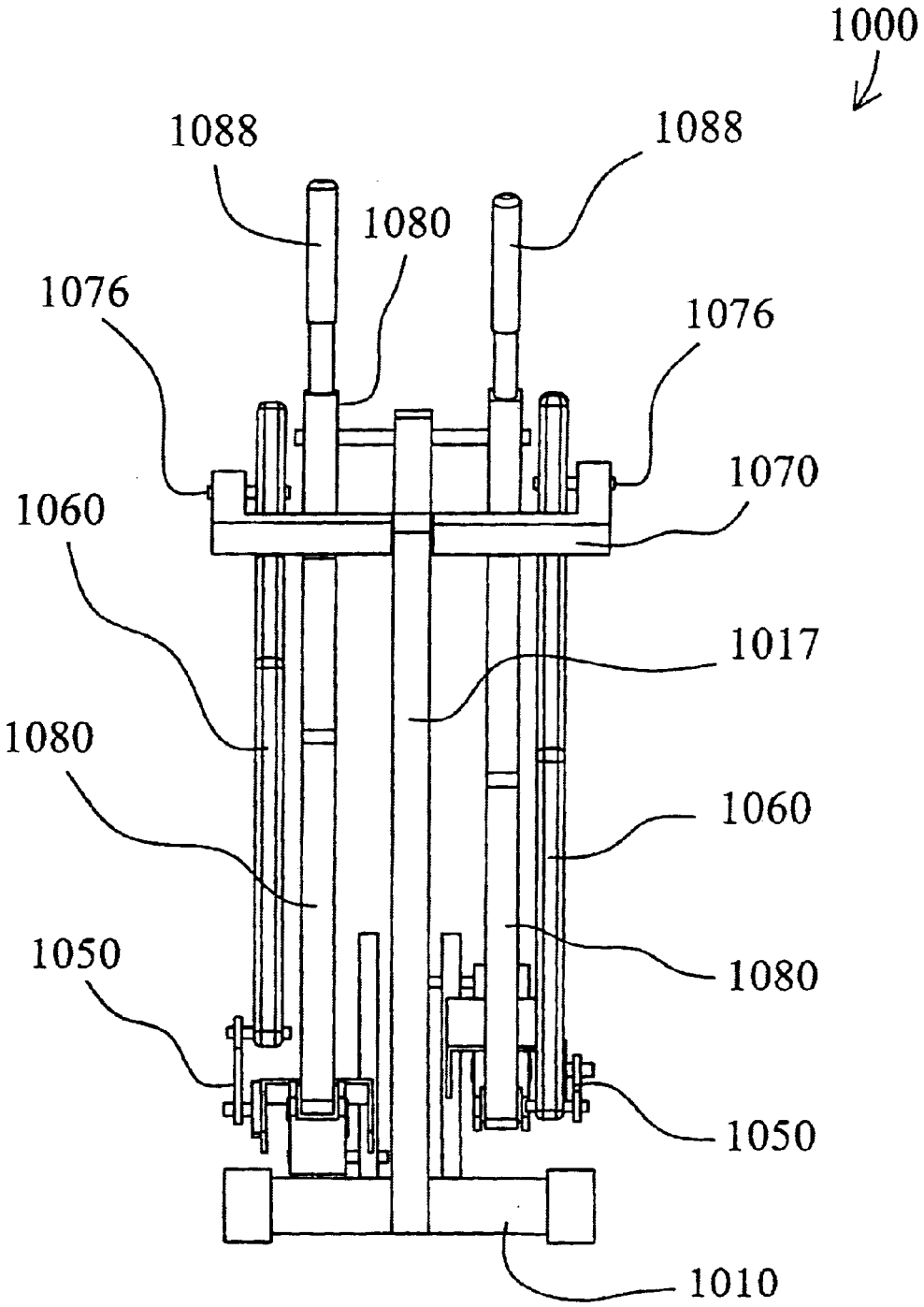
FIG. 15 is a front end view of the exercise apparatus of FIG. 12.

On each side of the machine 600, the intermediate links 650 and 660 cooperate with the rocker link 640 and the bar 630 to define a parallelogram four bar linkage. The arrangement links rotation of the cranks 620 and 621 to generally vertical pivoting of the rocker links 640 and generally horizontal pivoting of the intermediate links 650 and 660. Moreover, except for the points where the bars 630 connect to respective cranks 620 and 621, all points on the bars 630 move through generally elliptical paths. FIG. 11 shows the path traversed by the pivot axis defined each forward intermediate link 650 and a respective foot supporting bar 630. The handles 655 are also constrained to move through generally elliptical paths, thereby providing a more fluid arm exercise motion to accompany the elliptical leg exercise motion. FIG. 11 also shows the path traversed by an intermediate point on each of the handles 655.

Figure 9:
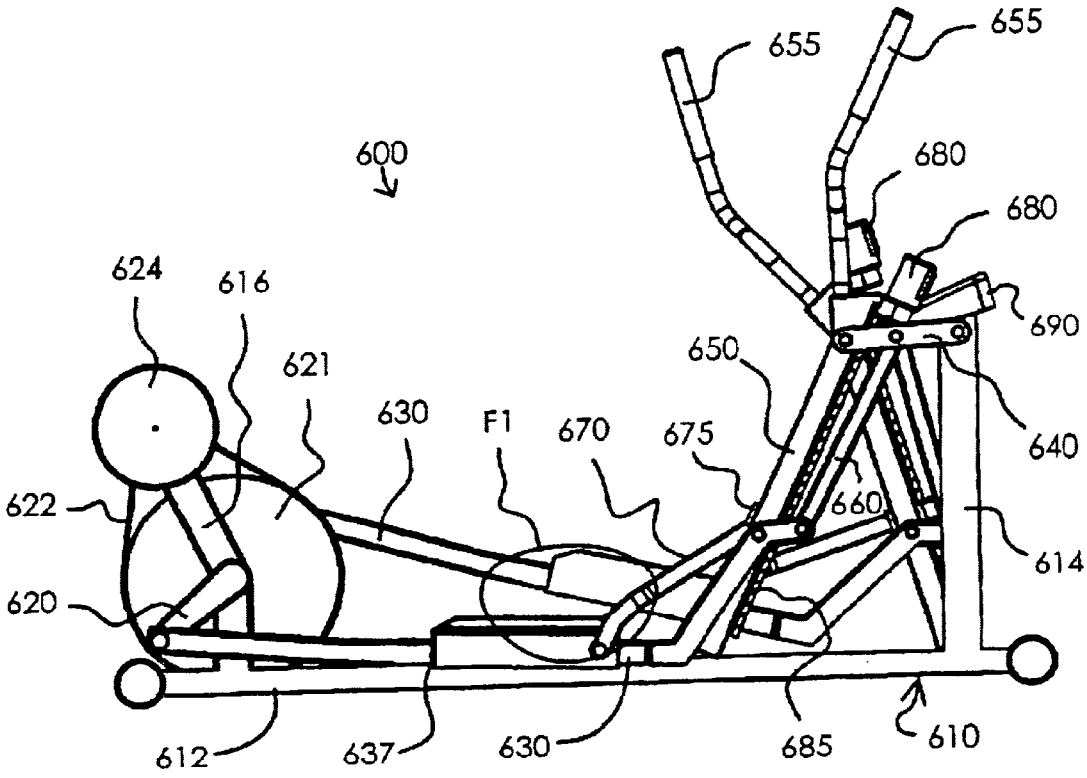
FIG. 9 is a side view of the exercise apparatus of FIG. 6, showing the apparatus configured to generate a relatively short foot path.
Figure 10:
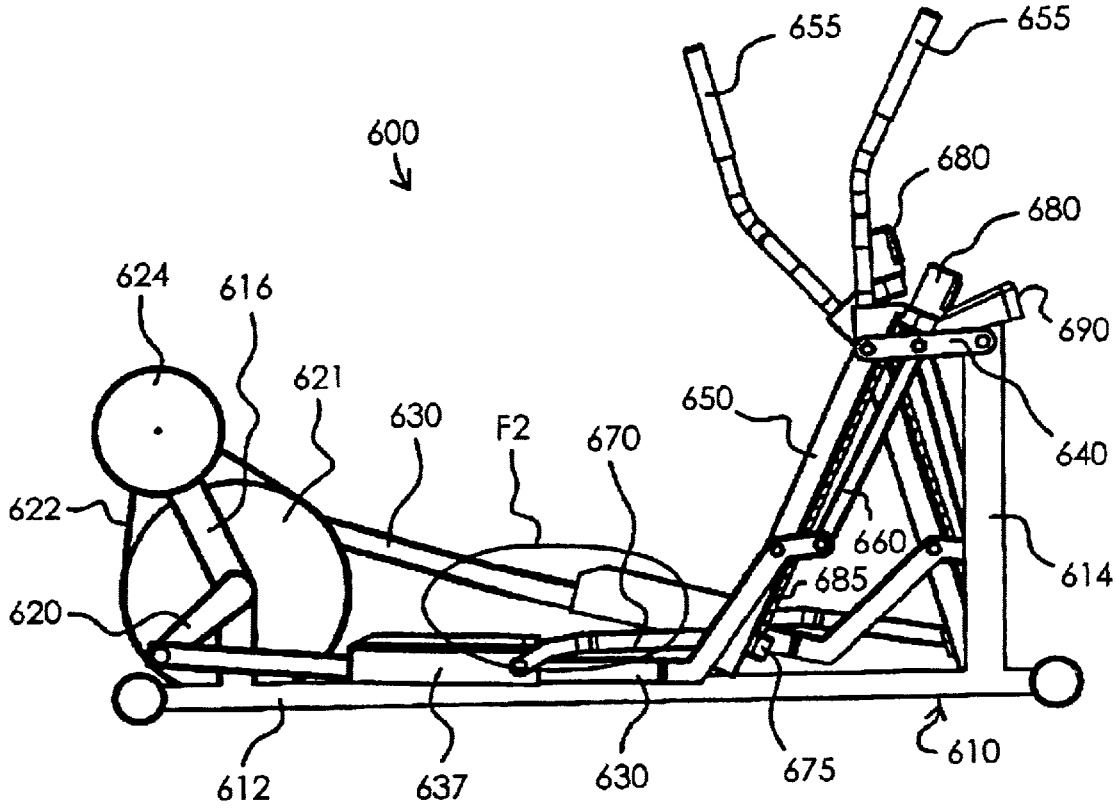
FIG. 10 is a side view of the exercise apparatus of FIG. 6, showing the apparatus configured to generate a relatively long foot path.

On each side of the apparatus 600, a foot support or skate 637 is movably mounted on a respective bar 630, preferably by means of rollers. Also, a drawbar or connector link 670 is pivotally connected between a respective skate 637 and the lower end of a respective intermediate link 650. In this regard, each connector link 670 is pivotally connected to a respective bracket 675, which in turn, is slidably mounted on a respective intermediate link 650. Each bracket 675 is threaded onto a lower end of a respective lead screw 685, and an upper end of lead screw 685 is operatively connected to a respective motor 680. As a result of this arrangement, operation of the motors 680 causes the brackets 675 to slide up and down on respective intermediate links 650. FIG. 9 shows a relatively short foot path F1 that is generated when the brackets 675 are moved upward, relatively closer to the pivot axis associated with the intermediate links 650. FIG. 10 shows a relatively long foot path F2 that is generated when the brackets 675 are moved downward, relatively farther from the pivot axis associated with the intermediate links 650. The motors 680 are preferably connected to the user interface 690 (which is like the interface 190 but enhanced to facilitate operation of the motors 680) by means known in the art.

Yet another embodiment of the present invention is designated as 1000 in FIGS. 12–15. The apparatus 1000 has a frame 1010 that includes a base designed to rest upon a floor surface; a forward stanchion 1017 extending upward from the base at its forward end 1011; and a rearward stanchion 1018 extending upward from the base at its rearward end. Left and right flywheels or cranks 1020 are rotatably mounted on the rearward stanchion 1018 and rotate relative thereto about a crank axis. As on other embodiments, the cranks 1020 may be connected to various known devices suitable for providing resistance and/or otherwise altering the inertia of the linkage assembly. Left and right rails or links 1030 have rearward ends which are rotatably connected to radially displaced portions of respective cranks 1020. The resulting axes of rotation are disposed at a crank radius from the crank axis. Forward ends of the rails 1030 are constrained to move in reciprocal fashion relative to the frame 1010. Left and right foot supports or skates 1040 are movably mounted on intermediate portions of respective rails 1030. Each skate 1040 is sized and configured to support one foot of a standing person. On the embodiment 1000, opposing pairs of rollers are rotatably mounted on the skates 1040 and rollable along outwardly opening channels on the rails 1030.

Left and right drawbars or links 1050 have rearward ends rotatably connected to respective skates 1040; and forward ends rotatably connected to lower ends of respective rocker links 1060. Opposite, upper ends of the rocker links 1060 are rotatably connected to respective rocker links 1070 at pin joints 1076. The rocker links 1070 pivot about a common axis 1077 (see FIG. 13) relative to the forward stanchion 1017. Multiple holes 1067 are provided in the rocker links 1060 to adjust the locations of the pin joints 1076 along the upper end of the rocker links 1060.

Intermediate portions of the rocker links 1060, disposed just below the upper ends, are rotatably connected to intermediate portions of respective rocker links 1080 at pin joints 1086. The rocker links 1060 may be described as intermediate rocker links because they are disposed and interconnected between the rocker link 1070 and the rocker links 1080. Relatively higher intermediate portions of the rocker links 1080 are rotatably connected to the forward stanchion 1017. Upper distal ends 1088 of the rocker links 1080 are sized and configured for grasping; and lower ends of the rocker links 1080 are rotatably connected to forward ends of respective rails 1030.

The resulting linkage assembly links rotation of the cranks 1020 to generally elliptical motion of the skates 1040. The skates 1040 move vertically together with the rails 1030 and horizontally relative to the rails 1030. With regard to horizontal movement, the cranks 1020 cause the handle bar rockers 1080 to pivot relative to the frame 1010. Since the intermediate rockers 1060 do not share a frame based pivot axis with the handle bar rockers 1080, they pivot relative to the handle bar rockers 1080 and thereby move the skates 1040 relative to the rails 1030. The amount of relative horizontal movement may be adjusted by changing the locations of the pin joints 1076, which are constrained to move in reciprocal fashion relative to both the frame 1010 and the pin joints 1086.

Other reciprocal motion constraints may be substituted for those shown without departing from the scope of the present invention. For example, in one alternative embodiment, slots are provided in the upper ends of the intermediate rocker links to accommodate pins extending from opposite ends of a support configured like the single rocker link 1070. During steady state operation, the support remains rigid relative to the stanchion 1017, and the pins bear against the walls of the slots. The support is selectively rotatable relative to the stanchion 1017 for purposes of adjusting the amount of horizontal movement between the skates 1040 and the rails 1030.

Another embodiment of the present invention is designated as 1100 in FIGS. 16–17. The apparatus 1100 is similar in many respects to the previous embodiment 1000 and thus, the following description will focus primarily on the distinctions between the respective linkage assemblies.

Left and right cranks 1120 are rotatably mounted on opposite sides of the frame 1110 proximate the rear end thereof, and a stanchion 1117 extends upward from the frame 1110 proximate the front end thereof. Left and right rails 1130 have rear ends rotatably mounted to radially displaced portions of respective cranks 1120; and front ends rotatably connected to lower ends of respective handle bar links 1180. Left and right foot skates 1140 have rear ends movably mounted on intermediate portions of respective rails 1130; and front ends rotatably connected to lower ends of respective rocker links 1160. Opposite, upper ends of the rocker links 1160 are rotatably connected to the forward stanchion 1117; and intermediate portions of the rocker links 1160, proximate the upper ends thereof, are rotatably connected to intermediate portions of the handle bar links 1180 by pin joints 1187.

Upper distal ends 1188 of the handle bar links 1180 are sized and configured for grasping. Upper portions of the handle bar links 1180, disposed between the upper ends 1188 and the pin joints 1187, are rotatably connected to respective rocker links 1170 which, in turn, are rotatably connected to the forward stanchion 1117. The rocker links 1160 are constrained to move in reciprocal fashion relative to both the frame 1110 and respective handle bar links 1180. As a result of this arrangement, the rails 1130 and the links 1160, 1170, and 1180 cooperate to link rotation of respective cranks 1120 to generally elliptical motion of respective foot skates 1140.

Yet another arrangement is designated as 1100' in FIG. 18. The rocker links 1160 are rotatably connected to stanchion 1117', which has been modified to provide multiple points of connection for left and right supports 1175. The supports 1175 provide bearing members 1177 which are disposed within slots 1178 formed in the upper portions of the handle bar links 1180, between the handle ends 1188 and the pin joints 1187. During steady state operation, the supports 1175 remain rigid relative to the stanchion 1117', and the pins 1177 bear against the walls of the slots 1178. The supports 1175 may be selectively repositioned relative to the stanchion 1117' for purposes of adjusting the configuration of the path traversed by the foot skates 1140.

The present invention is described with reference to particular embodiments and specific applications. Recognizing that this disclosure will enable persons skilled in the art to derive additional embodiments, improvements, and/or applications, the scope of the present invention should be limited only to the extent of the following claims.

What is claimed is:

1. An exercise apparatus, comprising:

a frame having a base that is configured to rest upon a floor surface;

a left crank and a right crank, wherein each said crank is rotatably mounted on the frame;

a left rocker link and a right rocker link, wherein each said rocker link is pivotally mounted on the frame;

a left bar and a right bar, wherein each said bar has a first end rotatably connected to a respective crank;

first and second left intermediate links, wherein each of said left intermediate links is pivotally interconnected between the left rocker link and an opposite, second end of the left bar;

first and second right intermediate links, wherein each of said right intermediate links is pivotally interconnected between the right rocker link and an opposite, second end of the right bar; and a left foot support and a right foot support, wherein each said foot support is supported by an intermediate portion of a respective bar and constrained to move through a generally elliptical path in response to rotation of each said crank.

2. The exercise apparatus of claim 1, wherein an upper distal end of one of the left intermediate links is sized and configured for grasping, and an upper distal end of one of the right intermediate links is sized and configured for grasping.

3. The exercise apparatus of claim 2, wherein said one of the left intermediate links is pivotally connected to a distal end of the left rocker link, and said one of the right intermediate links is pivotally connected to a distal end of the right rocker link.

4. The exercise apparatus of claim 1, wherein each said rocker link pivots through a range of generally horizontal orientations.

5. The exercise apparatus of claim 4, wherein said intermediate links pivot through a range of generally vertical orientations.

6. The exercise apparatus of claim 1, wherein each said foot support is movably mounted on a respective bar and operatively connected to a respective one of the intermediate links.

7. The exercise apparatus of claim 6, wherein a left connector link has a first end pivotally connected to the respective one of the left intermediate links, and a second end pivotally connected to the left foot support, and a right connector link has a first end pivotally connected to the respective one of the right intermediate links, and a second end pivotally connected to the right foot support.

8. The exercise apparatus of claim 7, wherein the first end of each said connector link is selectively movable along a respective one of the intermediate links to adjust the elliptical path of each said foot support.

9. The exercise apparatus of claim 8, wherein the first end of each said connector link is pivotally connected to a bracket, and each said bracket is slidably mounted on a respective one of the intermediate links.

10. The exercise apparatus of claim 9, wherein each said bracket is threadably mounted on a respective lead screw, and each said lead screw is operatively connected to a respective motor, and each said motor is mounted on a respective one of the intermediate links.

11. An exercise apparatus, comprising:

a frame having a base that is configured to rest upon a floor surface;

a left crank and a right crank, wherein each said crank is rotatably mounted on the frame;

a left bar and a right bar, wherein each said bar has a first end rotatably connected to a respective crank;

a left foot support and a right foot support, wherein each said foot support is supported by an intermediate portion of a respective bar;

a left guiding means for guiding an opposite, second end of the left bar through a closed loop in response to rotation of said left crank; and a right guiding means for guiding an opposite, second end of the right bar through a closed loop in response to rotation of said right crank, wherein each said guiding means includes a rocker link pivotally mounted on the frame, and at least one intermediate link pivotally interconnected between a respective rocker link and a respective bar.

12. The exercise apparatus of claim 11, wherein on each side of the frame, an upper distal end of one said intermediate link moves through a generally elliptical path and is sized and configured for grasping.

13. The exercise apparatus of claim 11, wherein each said foot support is movably mounted on a respective bar, and on each side of the frame, a drawbar link is pivotally interconnected between one said intermediate link and a respective foot support.

14. The exercise apparatus of claim 13, further comprising a means for adjusting where each said drawbar link is pivotally connected to a respective intermediate link.

15. The exercise apparatus of claim 11, wherein each said guiding means includes first and second intermediate links pivotally interconnected between a respective rocker link and a respective bar.

16. An exercise apparatus, comprising:

a frame having a base that is configured to rest upon a floor surface;

a left crank and a right crank, wherein each said crank is rotatably mounted on the frame;

a left bar and a right bar, wherein each said bar has a first end rotatably connected to a respective crank;

a left foot support and a right foot support, wherein each said foot support is supported by an intermediate portion of a respective bar; and a left rocker assembly and a right rocker assembly, wherein each said rocker assembly includes three links, and at least one of the links is pivotally connected to the frame, and at least one of the links is pivotally connected to a respective bar, and each of the links is pivotally connected to at least one other of the links, thereby constraining each said foot support to move through a generally elliptical path.

17. The exercise apparatus of claim 16, wherein a first one of the links is pivotally connected to the frame, and a second one of the links is pivotally interconnected between the bar and the first one of the links, and a third one of the links is pivotally interconnected between the bar and the first one of the links.

18. The exercise apparatus of claim 16, wherein a respective handle is provided on an upper end of one of the links in each said rocker assembly.

* * * * *